US008214949B2

(12) United States Patent
Thompson

(10) Patent No.: US 8,214,949 B2
(45) Date of Patent: Jul. 10, 2012

(54) ARTICLE OF BEDDING

(76) Inventor: Mark Anthony Thompson, Cheshire (GB)

( * ) Notice: Subject to any disclaimer, the term of this patent is extended or adjusted under 35 U.S.C. 154(b) by 0 days.

(21) Appl. No.: 12/610,668

(22) Filed: Nov. 2, 2009

(65) Prior Publication Data

US 2010/0043144 A1 Feb. 25, 2010

Related U.S. Application Data

(63) Continuation of application No. 12/034,908, filed on Feb. 21, 2008, now abandoned, which is a continuation of application No. PCT/GB2006/003040, filed on Aug. 14, 2006.

(30) Foreign Application Priority Data

Aug. 24, 2005 (GB) ..... 0517315.8

(51) Int. Cl.
*A47G 9/00* (2006.01)

(52) U.S. Cl. ..... 5/494; 5/485; 5/498; 5/500; 5/502

(58) Field of Classification Search ..... 5/485, 486, 5/494, 495, 496, 497, 500, 482, 488, 498, 5/499, 502

See application file for complete search history.

(56) References Cited

U.S. PATENT DOCUMENTS

| | | | | | |
|---|---|---|---|---|---|
| 938,968 | A * | 11/1909 | Caldwell | 5/501 |
| 2,627,617 | A * | 2/1953 | Avila | 5/494 |
| 2,888,009 | A * | 5/1959 | Taylor | 128/873 |
| 3,254,348 | A * | 6/1966 | Di Addario | 5/499 |
| 3,857,124 | A | 12/1974 | Hadley | |
| 4,304,018 | A * | 12/1981 | McClam | 5/494 |
| 4,402,098 | A * | 9/1983 | McClam | 5/494 |
| 5,208,927 | A | 5/1993 | Lachmar | |
| 5,566,411 | A * | 10/1996 | Eiler | 5/494 |
| 5,794,285 | A | 8/1998 | Burch | |
| 5,884,349 | A | 3/1999 | Gretsinger | |
| 6,539,656 | B2 * | 4/2003 | Maas et al. | 40/546 |

FOREIGN PATENT DOCUMENTS

| | | | |
|---|---|---|---|
| FR | 1509028 | A | 3/1968 |
| FR | 2239969 | A | 3/1975 |
| FR | 2325339 | A | 4/1977 |
| GB | 2241643 | A | 9/1991 |
| GB | 2273870 | A | 6/1994 |
| WO | 95/28862 | A | 11/1995 |
| WO | 00/59349 | A1 | 1/2000 |

* cited by examiner

*Primary Examiner* — William Kelleher

(57) ABSTRACT

An article of bedding comprising a bottom sheet (11) having side walls (12) thus to form a box sheet to be placed elastically over a mattress (10), and a top cover (14) having its edges attached to those of the bottom sheet (11) by means of a gusset (16). A sliding clasp fastener or the like (15) is provided to attach the edges of the bottom sheet and top cover together respectively when the article is not in use. A pillowcase (18) is permanently or removably attached to one end of the sheet and has an opening for insertion and removal of a pillow. The entire article, possibly excluding the pillow, is preferably of machine washable materials. An article made in this way ensures that the top cover which may contain a duvet, cannot slide off the bed inadvertently and therefore the occupant, most likely a child, is kept warm and safe from falling out of bed whilst having freedom of movement within the enclosure formed by the bottom sheet and top cover.

6 Claims, 1 Drawing Sheet

ARTICLE OF BEDDING

PRIORITY INFORMATION

This application is a continuation of U.S. patent application Ser. No. 12/034,908 filed on Feb. 21, 2008, now abandoned, which is a continuation of International Application No. PCT/GB2006/003040 filed on Aug. 14, 2006 which claims priority to Great Britain Patent Application No. 0517315.8 filed on Aug. 24, 2005 all of which are incorporated by reference in their entirety herein.

BACKGROUND OF THE INVENTION

1. Field of the Invention

This invention concerns an article of bedding comprising a bottom sheet and a top cover attached together to form a sleeping enclosure. Since the advent of duvets as opposed to blanket and sheet combinations which are tucked under a mattress, several attempts have been made to ensure that a duvet remains in place centrally over the bed and does not tend to move to one side or the other as a result of the occupant of the bed moving during sleep. The invention is particularly, though not exclusively, concerned with children's bedding, the importance being to keep a child warm during the night without the need for elaborate devices to maintain the central location of the duvet.

2. Brief Description of the Prior Art

Some known devices have included straps or other ties which are attached to a duvet and pass around or are attached to the mattress of the bed. One of the disadvantages of these known devices is that the duvet is held tightly over the occupant thus reducing freedom of movement within the sleeping enclosure.

SUMMARY OF THE INVENTION

It is an object of the present invention to provide an improved article of bedding for this purpose.

According to the present invention an article of bedding comprises a bottom sheet to be laid upon a mattress, the bottom sheet having means for attachment to a mattress thus to retain the bottom sheet thereon, a top cover superimposed upon the bottom sheet and having at least two edges attached to at least two corresponding edges of the bottom sheet to form therewith a sleeping enclosure; characterised in that the manner of attachment of the top cover to the bottom sheet is such as to afford the top cover freedom of movement upwards of the bottom sheet at said corresponding edges thereof.

A gusset may be attached to and disposed between the corresponding edges respectively of the bottom sheet and the top cover to provide freedom of movement within the sleeping enclosure.

The corresponding edges of the bottom sheet and the top cover may be selectively attached closely together by two-part fastening means such as a sliding clasp fastener or a hook and loop fastener, when the bed is not occupied.

The top cover may be formed as an envelope containing a duvet which, optionally, may be removable for washing separately.

The means for attachment of the bottom sheet to a mattress may be flexible side walls to form a box sheet elasticated around at least a part of the bottom edge thereof.

The article may include a pillowcase attached to at least one edge region of the bottom sheet with an opening for insertion or removal of a pillow.

The article may consist entirely of machine washable materials.

BRIEF DESCRIPTION OF THE DRAWINGS

An embodiment of the invention will now be described, by way of example only, with reference to the accompanying drawings, in which.

DETAILED DESCRIPTION OF THE INVENTION

Figure 2:
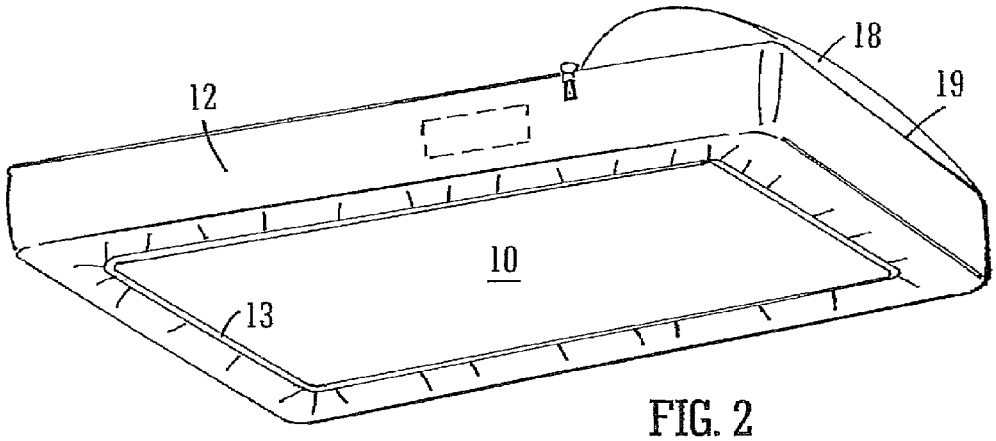
FIG. 2 is an underside view of a mattress with the article thereon.

Referring now to the drawings, they show on a mattress 10 an article of bedding made in accordance with the invention. It comprises a bottom sheet 11 which is laid upon the mattress 10 and is made, typically, from a breathable polyester/cotton mix fibre. Descending from all four edges of the bottom sheet 10 are side walls 12 which may be of a material similar to that of the sheet 10 or may be of a fleece material, for example. The bottom edges 13 of the side wall, at least in the corner regions, are preferably elasticated thus to be retained on the mattress as can be seen in FIG. 2, in the form of a box sheet.

A top cover 14 of corresponding width is attached around three of its edges to the sheet 11 by a double sliding clasp fastener 15 thus to form, with the sheet 11 a sleeping enclosure rather like a sleeping bag. Attached to and disposed between the corresponding edges of the bottom sheet and top cover, partly around three sides thereof, is a gusset 16. This may be permanently attached, for example by stitching, to the respective edges of the bottom sheet and top cover, or there may be a fastener to enable the top cover to be removed, with or without the gusset 16, from the bottom sheet if required. However, it is envisaged that, preferably, the entire article will be as one so that it may be removed in its entirety from the mattress, for washing.

The top cover 14 may have an opening as shown at 17 to receive a duvet. In addition, or alternatively, at least one face of the top cover 14 may be of a fleece material.

A pillowcase 18 which may have an opening along the front or rear edge or at one or both ends to receive a pillow, is preferably attached to the bottom sheet 11 by stitching at 19.

The top cover 14 is of such a length that in a portion 14*a* it partly overlaps the pillowcase 18 for added warmth and it is seen that the gusset 16 along the side edges of the article extends slightly in excess of half of the overall length of the cover 14 with its portion 14*a*.

Figure 3:
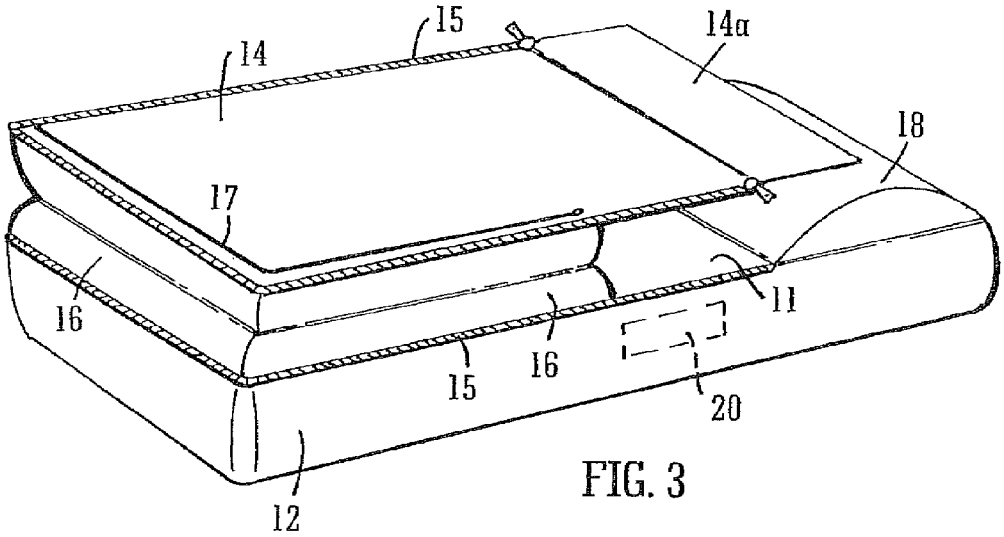
FIG. 3 is a view showing the article in an open condition ready for use.

As can be seen from FIG. 3, when the fasteners 15 are opened the gusset may extend so that the entire top cover may be spaced from the sheet 11 to provide freedom of movement for the occupant who may gain access to the sleeping enclosure very readily by turning back the top cover as far as the adjacent extent of the gusset.

It will be appreciated that while the top cover which may contain a duvet, is attached to the bottom sheet and therefore cannot slide off the bed inadvertently, nevertheless the freedom of movement typically provided by a freely superimposed duvet, is retained by the provision of the gusset.

Figure 1:
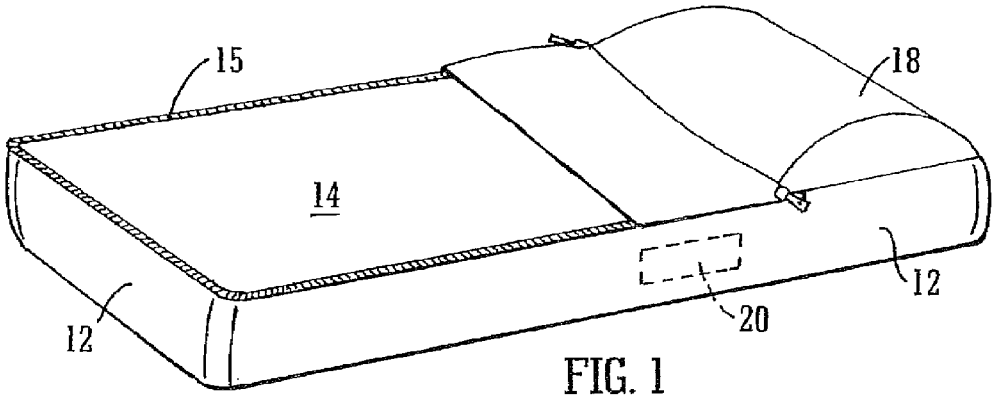
FIG. 1 shows an article of bedding attached to a mattress.

When the bed is not occupied, the fasteners 15 may be closed, with gusset 16 tucked inside, to present a neat appearance, as shown in FIG. 1

It is envisaged that the entire article of bedding shall be made of materials which are machine washable and may be tumble-dried so that the whole item may be laundered without taking it apart save, perhaps, for the pillow being removed from the pillowcase. If the top cover 14 contains a removable duvet it might render the item more readily machine washed if the duvet core were removed, thus reducing the bulk of the item.

One or more pockets 20 may be provided in the side walls 12 which thus may contain personal items.

It will be appreciated that some or all of the outer surfaces of the article may bear decorative patterns or ornamentation including, for example, cartoon characters.

It is not intended to limit the invention to the above example only. For example, the sliding claps fasteners 15 may be replaced by hook and loop fasteners or other alternative means such as press studs. The pillowcase 18 may be permanently stitched all round to the bottom sheet 11 or attached thereto by a removable fastener.

Instead of the gusset being disposed between the opposed parts of the sliding clasp fastener 15, one part of the latter may extend around one edge of the gusset with the other edge of the gusset stitched to the corresponding edge of the top cover or bottom sheet, whereby when the top cover is lying in superimposed relationship with the bottom sheet 11, and the fastener 15 is closed, the gusset will partially overhang the sides of the mattress.

The gusset 16 may extend further towards the pillow but be left, in the extended region, unstitched from the bottom sheet to allow ready access for the occupant.

The gusset may have a thickness greater than that of the bottom sheet to provide additional warmth.

I claim:

1. A unitary article of bedding comprising:

(a) a bottom sheet formed from a material comprising a fibre mix, the bottom sheet defining four edges and a width;

(b) sidewalls extending from the four edges of the bottom sheet, the sidewalls defining corner regions, the corner regions being elasticated such that they are adapted to fit over a mattress and hold the bottom sheet in place as the bottom sheet covers the mattress;

(c) a top cover having a first portion and a second portion, where the first portion is multilayered for housing a removable duvet between two of its layers and the second portion is a single layer, whereby the top cover has a width approximately equal to the width of the bottom sheet, the length of the first portion is greater than the second portion, and the combined length of the first and second portion is less than the length of the bottom sheet, the top cover also defining four edges;

(d) a double sliding clasp fastener including:

(i) a first portion coupled to three edges of the bottom sheet and (ii) a second portion coupled to the three corresponding edges of the first portion of the top cover;

the sliding clasp fastener being such that it may be placed into:

(A) a first configuration wherein the bottom sheet is coupled along three of its edges to the first portion of the top cover and (B) a second configuration where the bottom sheet is not coupled to the first portion of the top cover such that the bottom sheet and the first portion of the top cover may be spaced apart from one another;

(e) a gusset attached by stitching to three edges of the bottom sheet and to the corresponding three edges of the first portion of the top sheet, the gusset:

(i) having a width along one of the three edges that is approximately equal to the width of the corresponding edge of the first portion of the top cover and the bottom sheet, and (ii) a length along two of the three edges that is less than and over half of the combined length of the first and second portions of the top cover, the gusset being formed such that it may be tucked in between the top cover and the bottom sheet when the double sliding clasp fastener is configured in the first position; and (f) a pillowcase attached by stitching to the bottom sheet, such that the length of the second portion of the top cover at least partly overlaps the pillow case.

2. The article of claim 1 wherein the bottom sheet and the sidewalls are formed from different materials.

3. The article of claim 2 wherein the sidewalls are formed from fleece materials.

4. The article of claim 2 wherein the top cover and the sidewalls are formed from the same material.

5. The article of claim 1 further including material coupled to at least one of the sidewalls to form a pocket.

6. The article of claim 1 wherein the thickness of the gusset is greater than the thickness of the bottom sheet.

* * * * *